United States Patent [19]

Pollich

[11] 4,421,028

[45] Dec. 20, 1983

[54] DELIVERY TABLE FOR SHEET-FED PRINTING PRESSES

[75] Inventor: Gerhard Pollich, Heidelberg, Fed. Rep. of Germany

[73] Assignee: Heidelberger Druckmaschinen AG, Heidelberg, Fed. Rep. of Germany

[21] Appl. No.: 935,784

[22] Filed: Aug. 22, 1978

Related U.S. Application Data

[63] Continuation of Ser. No. 771,788, Feb. 24, 1977, which is a continuation of Ser. No. 631,679, Nov. 13, 1975, abandoned.

[30] Foreign Application Priority Data

Feb. 15, 1975 [DE] Fed. Rep. of Germany ..... 25063916

[51] Int. Cl.[3] ..... B41F 13/64

[52] U.S. Cl. ..... 101/240; 271/189; 271/218; 414/39

[58] Field of Search ..... 101/237–240, 101/136; 214/6 DK; 270/82, 85; 108/153–159; 271/189–192, 207, 218

[56] References Cited

U.S. PATENT DOCUMENTS

| | | | |
|---|---|---|---|
| 2,638,394 | 5/1953 | Ulrich | 108/159 X |
| 2,788,902 | 4/1957 | Nowicki | 108/157 |
| 3,410,424 | 11/1968 | Rooney | 214/6 D K |

*Primary Examiner*—A. J. Heinz

*Attorney, Agent, or Firm*—Herbert L. Lerner; Laurence A. Greenberg

[57] ABSTRACT

In a sheet-fed printing press, a delivery table including a table top, leg-holding means secured to the underside thereof, and a plurality of legs removably held by said leg-holding means.

1 Claim, 4 Drawing Figures

Fig. 1
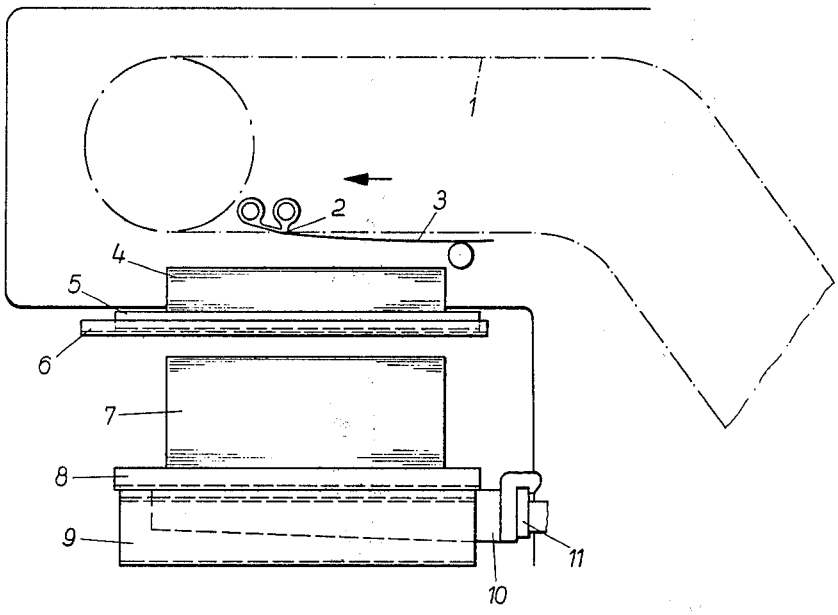
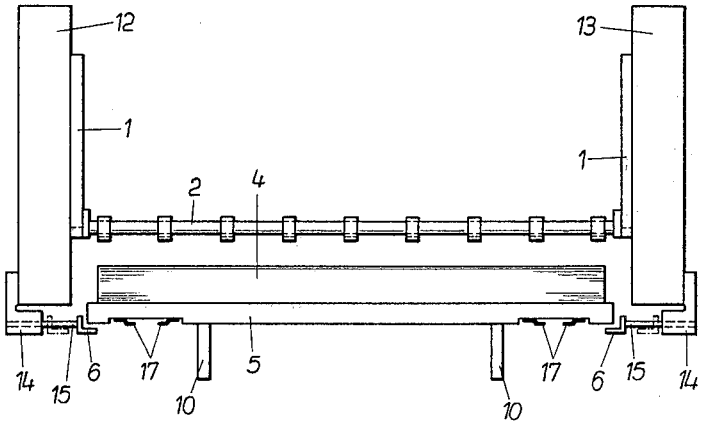
Fig. 2

DELIVERY TABLE FOR SHEET-FED PRINTING PRESSES

This is a continuation of application Ser. No. 771,788 filed Feb. 24, 1977 which is a continuation of Ser. No. 631,679, filed Nov. 13, 1975 now abandoned.

The invention relates to a delivery table for sheet-fed printing presses which is provided with legs at the underside thereof, the sheets that are imprinted being deposited and stacked on the delivery table.

In order to change a sheet pile while the printing press is running, it has been known heretofore from German Published Prosecuted application DAS No. 2 218 535 to insert auxiliary pile board above the full pile at the time of the pile change, so that the board receives thereon the sheets delivered by the delivery system until an empty delivery table has been inserted and raised sufficiently to enable the auxiliary pile board together with the accumulated sheets to lie thereon. A disadvantage of this heretofore known construction is that the auxiliary pile board must be transported together with the delivery table to further processing stages after the full pile height has been reached. A delivery table and an auxiliary pile board are required, moreover, for each pile change.

Intermediate pile devices are also known from German Published Prosecuted Application DAS No. 1 018 432 which, instead of an auxiliary pile board, utilize a lattice frame or the like, which is inserted above the full pile at the time required for the pile change and is then withdrawn again. Devices of this type have not proved successful, however, since they cannot be withdrawn without shifting and damaging the sheets lying thereon.

It is accordingly an object of the invention to provide a delivery table for sheet-fed printing presses which avoids the foregoing shortcomings of the heretofore known delivery tables of this general type and which is so constructed that it can be used both as an auxiliary pile board and as a delivery table, so that no additional auxiliary pile board is necessary.

With the foregoing and other objects in view, there is provided in accordance with the invention, a delivery table for sheet-fed printing presses having a table top and legs or feet exchangeably or removably mounted in holders at the underside of the table top. The holders are in the form of rails, wherein guide bars or strips, that are provided on the legs, slidingly engage. A delivery table of this construction, with the legs removed, can thus be used as an auxiliary pile board. It is thereby possible to insert the delivery table into the narrow space between two sheets without damaging the latter. When the full pile lying beneath the inserted delivery table top has been withdrawn from the printing press, the delivery table top is engaged and supported by the pile table carriers and a new pile is formed. During this time the legs are re-inserted into the rails.

In accordance with a further feature of the invention, locking means, preferably drawback springs, are fastened to the rails and, when the legs are inserted into the delivery table top, automatically engage in notches formed in the guide bars or strips. Moreover, the rails are fastened to the underside of the delivery table top in one or more recesses the depth of which corresponds substantially to the thickness of the rails. Consequently there are no parts projecting from the delivery table top which, upon the insertion of the latter, could damage the surface of the sheets that have been imprinted.

Other features which are considered as characteristic for the invention are set forth in the appended claims.

Although the invention is illustrated and described herein as embodied in a delivery table for sheet-fed printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a diagrammatic side elevational view of a delivery system for a sheet-fed printing press according to the invention;

FIG. 2 is a front elevational view of FIG. 1;

Figure 3:
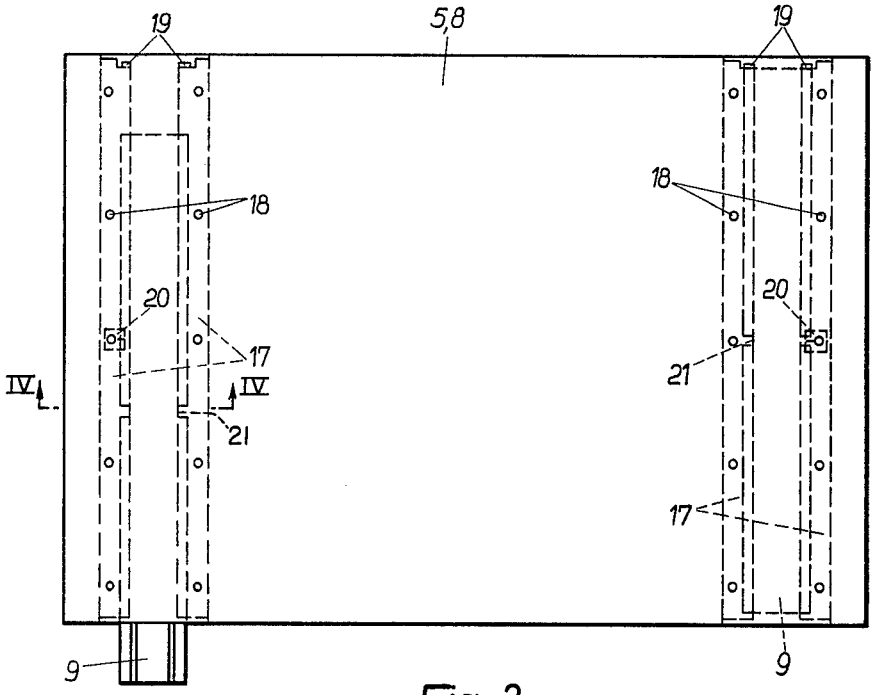
FIG. 3 is a plan view of the delivery table of the delivery system of FIGS. 1 and 2 showing the legs thereof.

Referring now to the drawing and, first, particularly in FIG. 1 thereof, there is shown a chain delivery system 1 which delivers printed sheets 3 by means of a delivery gripper 2 and lets them drop onto an intermediate sheet pile 4. The latter is carried by a delivery table 5 which is in turn, supported on both sides thereof by holding rails 6. Beneath the delivery table 5, a full main sheet pile 7 is carried by another delivery table 8. Legs 9 are disposed at the underside of the delivery table 8. In the illustrated embodiment, the delivery table 8 lies on pile table carriers 10, which are mounted on a conventional lifting device 11.

FIG. 2 shows side frames 12 and 13 of the printing press on which bearings 14 are secured, wherein guides 15 for the holding rails 6 are slideably mounted.

Figure 4:
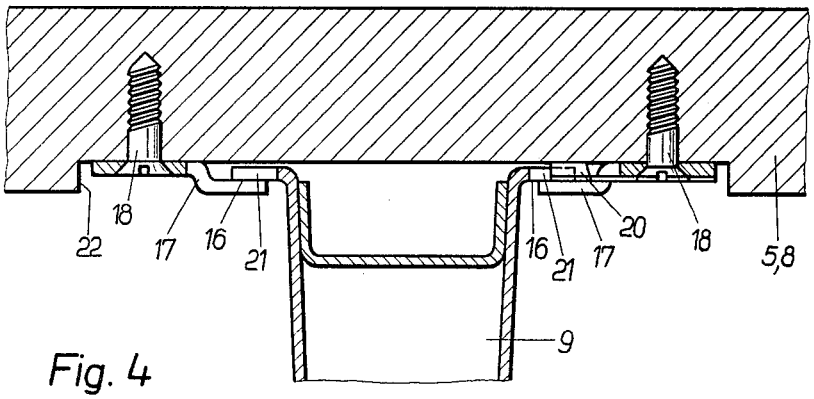
FIG. 4 is an enlarged fragmentary cross-sectional view of FIG. 3 taken along the line IV—IV in the direction of the arrows and showing part of a leg and the holder therefor.

In the plan view of FIG. 3, the delivery table 5, 8, is shown, a leg 9 having already been inserted on the right-hand side thereof, having been partially inserted therein on the left-hand side thereof. Guide strips or ledges 16 (FIG. 4) are provided on the legs 9 and engage in rails 17, which are in turn, fastened by screws 18 to the delivery table 5, 8. When the legs 9 are inserted fully, they engage stops 19 (FIG. 3) provided on the rails 17. In this position, as shown on the right-hand side of FIG. 3, locking drawback springs 20 engage in notches 21 provided in the guide drawback strips or bars 16.

The rails 17 are disposed in recesses 22 at the underside of the delivery table 5, 8, the depth of the recesses 22 corresponding substantially to the thickness of the rails 17. The delivery table 5, 8 thus has no projecting parts at the underside thereof.

The operation of the aforedescribed device of the invention is as follows:

The imprinted sheets 3 advanced by the delivery grippers 2 are initially stacked or piled on the delivery table 8 which lies on the pile table carrier 10. When the sheet pile 7 has reached the full height thereof, a new delivery table 5, from which the legs have been removed, is inserted above the pile 7. The new delivery or pile table 5 is laid temporarily on the holding rails 6 and receives thereon the substantially delivered sheets.

When the delivery table 5 is being inserted, the next delivered sheet is firmly held by conventional holding means such as suction device, mechanical grippers or the like.

Both the pile 7 and the delivery table 8 therewith are then removed from the printing press in a conventional manner and transported to another location for further processing. The pile table carriers 10 from which the delivery table 8 has been removed and, which are consequently free, are raised by the conventional lifting device 11 until they engage the delivery table 5 and the latter is supported thereon. The holding rails 6 are thereafter withdrawn to the position thereof shown in phantom in FIG. 2. The pile table carriers 10 then move downwardly in a conventional manner as the height of the pile increases. During the time that the pile table carriers 10 move downwardly under the weight of the ever-increasing sheet pile 4, the legs 9 are inserted with the aid of the guide ledges or strips 16 thereof into the rails 17 that are secured to the delivery table 5, 8. After the legs 9 have been installed, the delivery table 5,8, together with the full pile 4,7 can be removed from the machine in the aforedescribed manner.

There is claimed:

1. Method of removing printed sheets from a printing machine which comprises stacking printed sheets delivered from a sheet delivery system onto a legless first delivery table having means for securing supporting legs thereto, securing legs to the legless first delivery table, interposing a legless second delivery table between the first delivery table and the sheet delivery system, removing the first delivery table, and repeating the foregoing method steps with the second delivery table and a third delivery table.

* * * * *